US005711825A

United States Patent [19]

Bölling et al.

[11] Patent Number: 5,711,825

[45] Date of Patent: Jan. 27, 1998

[54] PROCESS FOR THE PRODUCTION OF GRAIN ORIENTED MAGNETIC STEEL SHEETS HAVING IMPROVED REMAGNETIZATION LOSSES

[75] Inventors: Fritz Bölling, Moers; Andres Böttcher, Duisburg; Manfred Espenhahn, Essen; Christof Holzapfel, Düsseldorf, all of Germany

[73] Assignee: Thyssen Stahl AG, Duisburg, Germany

[21] Appl. No.: 222,627

[22] Filed: Apr. 4, 1994

[30] Foreign Application Priority Data

Apr. 5, 1993 [DE] Germany ..... 43 11 151.3

[51] Int. Cl.[6] ..... C21D 8/12

[52] U.S. Cl. ..... 148/111; 148/112

[58] Field of Search ..... 148/111, 112, 148/113, 500, 505

[56] References Cited

U.S. PATENT DOCUMENTS

| | | | |
|---|---|---|---|
| 3,855,019 | 12/1974 | Salsgiver et al. | 148/111 |
| 3,976,517 | 8/1976 | Blank et al. | 148/111 |
| 4,692,193 | 9/1987 | Yoshitomi et al. | 148/111 |
| 4,753,692 | 6/1988 | Kuroki et al. | 148/111 |
| 4,806,176 | 2/1989 | Harase et al. | 148/111 |
| 4,863,532 | 9/1989 | Kuroki et al. | 148/307 |

FOREIGN PATENT DOCUMENTS

| | | | |
|---|---|---|---|
| 0125653 | 11/1984 | European Pat. Off. . | |
| 0219611 | 4/1987 | European Pat. Off. . | |
| 2201342 | 4/1974 | France . | |
| 2511045 | 2/1983 | France . | |
| 2422073 | 11/1974 | Germany . | |
| 3220255 | 12/1982 | Germany . | |
| 3229295 | 9/1986 | Germany . | |
| 3538609 | 8/1989 | Germany . | |
| 60-197819 | 10/1985 | Japan | 148/111 |
| 60-218426 | 11/1985 | Japan | 148/111 |

*Primary Examiner*—Sikyin Ip

*Attorney, Agent, or Firm*—Meltzer, Lippe, Goldstein, et al.

[57] ABSTRACT

A process for the production of grain oriented magnetic steel sheets comprises through-heating slabs containing more than 0.005% C, 2.5 to 6.5% Si, 0.03 to 0.15% Mn, 0.010 to 0.050% S, 0.010 to 0.035% Al, 0.0045 to 0.0120% N, and 0.020 to 0.300% Cu, the balance being iron and residual impurities, to a temperature which is lower than the solubility temperature $T_1$ of magnesium sulfide and higher than the solubility temperature $T_2$ of copper sulfide, $T_1$ and $T_2$ being dependent on the silicon content. The through-heated slabs are then hot roughed, followed by hot finish rolling at an initial temperature of at least 960° C. and a final rolling temperature of 880° C. to 1,000° C., to produce a hot rolled strip having a thickness in the range of 1.5 to 7 mm. During this last step, at least 60% of the total nitrogen content precipitates in the form of coarse AlN particles. Thereafter, the hot rolled strips are annealed at temperature of 880° C. to 1,150° C., followed by cooling at a cooling rate higher than 15 ° K./sec to induce further precipitation of AlN and copper sulfide particles. Thereafter the strip is cold rolled in one or more cold rolling stages to a final strip thickness of 0.1 mm to 0.5 mm, subjected to recrystallization and decarburization annealing in a wet atmosphere containing $H_2$ and $N_2$. A separating agent containing mainly MgO is then applied to both surfaces of the strip. The strip is then high temperature annealed, an insulating coating is applied and the strip is subjected to a final annealing.

11 Claims, 4 Drawing Sheets

PROCESS FOR THE PRODUCTION OF GRAIN ORIENTED MAGNETIC STEEL SHEETS HAVING IMPROVED REMAGNETIZATION LOSSES

BACKGROUND OF THE INVENTION

The invention relates to a process for the production of grain oriented magnetic steel sheets having a finished strip thickness in the range of 0.1 mm to 0.5 mm, wherein slabs produced by continuous casting or strip casting and containing more than 0.005%, preferably 0.02 to 0.10% C, 2.5 to 6.5% Si and 0.03 to 0.15% Mn are first through-heated in one or two stages and then hot roughed and finish rolled to a hot strip final thickness, whereafter the strips, hot rolled to the final thickness, are annealed and rapidly cooled and cold rolled in one or more cold rolling stages for the finished strip thickness, the cold rolled strips being then subjected to a recrystallizing annealing in a wet atmosphere containing $H_2$ and $N_2$ with simultaneous decarburization, the application of a separating agent mainly containing MgO to the cold strip surface on both sides, a high temperature annealing and lastly a final annealing with an insulating coating.

For the production of grain oriented magnetic steel sheets it is known to heat slabs, more preferably continuously cast slabs having a thickness in the range of approximately 150 to 250 mm and normally containing 0.025 to 0.085% C and 2.0 to 4.0% Si and also manganese, sulphur, and possibly aluminium and nitrogen, prior to hot rolling in one or two stages to a temperature of the order of magnitude of 1350° C. to a maximum of 1450° C., and to hold the slabs at said temperature for a sufficient period of time (through-heating) to ensure a homogeneous through-heating of the slabs. This step serves the purpose of completely putting into solution those particles such as, for example, sulphides (MnS) and nitrides (AlN) which are known as grain growth inhibitors and act as a control phase in high temperature annealing (secondary recrystallization).

More particularly in the two-stage heating and through-heating and solution annealing of the slabs, it is also known to provide a "pre-rolling" (intermediate rolling) between the first and second stage (DE-C3 22 52 784, DE-B2 23 16 808) to counteract excessive grain growth, with resulting incomplete secondary recrystallization during high temperature annealing. After a first stage of heating only to a temperature of approximately 1200° C. to 1300° C., the slabs are rolled with a degree of reduction related to their thickness or with a reduction in cross-section of 30 to 70% in order, for example, to adjust to more than 80% of the grains to an average maximum diameter of 25 mm. Next, in order to dissolve the manganese sulphides and the aluminium nitrides, comes the second heating stage to a maximum temperature of 1450° C. and a through-heating of the slabs at that temperature, whereafter the slabs, already reduced in thickness, are hot roughed and finish rolled into hot strip having a final thickness in the range of 1.5 to approximately 5 mm, and up to 7 mm at the maximum.

On the other hand, DE-C2 29 09 500 discloses a process for the production of grain oriented magnetic steel sheets, wherein the slabs, containing 2.0 to 4.0% Si, up to 0.085% C and up to 0.065% Al or some other known inhibitor, are heated prior to hot rolling in only one stage to a temperature of at least 1360° C., preferably higher than 1350° C., and through-heated—i.e., held for an adequate period of time, at that temperature. The intention is that the inhibitors should be completely dissolved prior to hot rolling and not prematurely precipitated, to prevent excessively large and coarse precipitations from occurring during hot rolling. Also, therefore, to prevent any precipitation of the inhibitors during the subsequent hot rolling, according to this prior art process the hot rolling comprises at least one recrystallization rolling during the finish rolling with at least a reduction per pass of more than 30% in a temperature range of 960° C. to 1190° C., the document stating expressly that the inhibitors are not precipitated during hot rolling. According to this prior art process, any precipitation of the inhibitors, and more particularly any coarsening of the particles possibly precipitated in any case are preferably avoided if the recrystallization rolling of the slabs, previously through-heated at a temperature of at least 1350° C., is performed in the temperature range of 1050° C. to 1150° C.

More particularly in the case of Al-containing slabs, their single-stage through-heating at a reduced temperature, in addition to the hot rolling, also in a reduced temperature range, cause a precipitation and coarsening of aluminium nitride, with the result that the secondary recrystallization in the following stages or process steps is incomplete. This leads to poor magnetic properties of the grain oriented magnetic steel sheets produced in this manner. In spite of this indication in DE-C2 29 09 500, in the process for the production of grain oriented magnetic electric sheets known from EP-B1 0 219 611, from which the invention starts, it is proposed that prior to hot rolling—i.e., prior to roughing and finish rolling—the slabs should be heated to a temperature in any case higher than 1000° C. to a maximum 1270° C. and through-heated at that temperature. At the same time the slabs contain 1.5 to 4.5% Si and also, according to the embodiments, the usual contents of carbon, manganese, aluminium and nitrogen, but preferably only a sulphur content of less than 0.007%.

In this prior art process the slabs are hot rolled in the usual manner, the hot rolled strip is heat treated and annealed, and then also in known manner cold rolled in one or two stages to the final sheet thickness. The cold rolled strip is then annealed for decarburization, whereafter a separating agent is applied to both sides of the surface of the cold strip, and finally the strip is subjected to a high temperature annealing for secondary recrystallization. However, the precipitations of (Si,Al)N particles, primarily occurring with the use of this process, are obviously active as an inhibitor and the grain oriented magnetic electric sheets can be produced with the required magnetic properties only if, at the end of the primary recrystallization and decarburization annealing and prior to the initiation of the secondary recrystallization, the cold rolled strip is subjected to a nitriding—i.e., an additional further process step.

The lowering of the temperature required for the through-heating and solution annealing of the slabs and which must be adjusted in the corresponding furnaces means in the first place the avoidance in an advantageous manner of the formation of liquid slag in said furnaces. In addition, such a reduction in the through-heating temperature represents a clear saving of energy, substantially lengthened furnace surface lives and more particularly an improved and cheaper production of the through-heated slabs. For this reason a number of further European Patent Applications of more recent date (EP-A1 0 321 695, EP-A1 0 339 474, EP-A1 0 390 142, EP-A1 0 400 549) also disclose processes for the production of grain oriented magnetic electric sheets with a temperature of less than approximately 1200° C. required for the through-heating of the slabs.

In the cases mentioned, in which the slabs preferably contain 0.010 to 0.060% Al, but less than approximately 0.010% S, aluminium nitrides can only incompletely be put into solution in the solution annealing of the slabs. Following decarburization annealing, as in the process known from EP-B10 219 611, therefore, the necessary inhibitors are produced by a nitrogenation or also a nitriding of the strip. This can be done, for example, by the adjustment of a special ammonia-containing gas atmosphere after the decarburization annealing and prior to the high temperature annealing and/or by the addition of nitrogen-containing compounds to the separating agent, which mainly contains MgO (e.g., as set forth in EP-A1 0 339 474, EP-A1 0 390 142).

The disadvantage of all these prior art processes is that for the production of the necessary inhibitors and therefore for the adjustment of the control phase, prior to the final high temperature annealing, at least one additional further process step is required. Additional process steps make it difficult, for example, to reproducibly manufacture grain oriented magnetic steel sheets having given required magnetic properties. Moreover, the performance of these process steps in the course of production is tied up with technical difficulties such as, for example, the precise adjustment of the special gas atmosphere in the nitrogenation treatment.

EP-B10 098 324 and EP-A2 0 392 535 disclose processes in which the through-heating temperature is below 1280° C. and an additional process step, such as, for example, nitriding is not absolutely necessary. According to EP-A2 0 392 535, the secondary recrystallization is stabilized by the adjustment of the hot rolling parameters, such as the final hot rolling temperature, degree of deformation (referred to the last three hot rolling passes) or coiling temperature. According to EP-B1 0 098 324 this stabilization is achieved by harmonization of the annealing conditions and the hot rolling and cold rolling parameters.

None of the citations mentioned hereinbefore starts from copper and sulphur contents such as those on which the process according to the invention is based. Magnetic steel sheets having such a composition are known, for example, from DE-A1 24 22 073 or DE-C2 35 38 609. DE-C2 32 29 295 discloses how properties can be improved by the addition of tin and copper. However, none of the three last-mentioned specifications discloses a process which supports the almost exclusive effect of copper sulphides as inhibitor or suggests through-heating temperatures lower than 1350° C.

Starting from this point, it is an object of the invention so to improve the process of the kind specified, with the advantageously reduced temperature for the solution annealing of the slabs, that more favourable values are achieved for the magnetic properties of the magnetic steel sheets, more particularly for the remagnetization losses $P_{1.7/50}$, without the use of further process steps.

SUMMARY OF THE INVENTION

According to the invention, a process for the production of grain oriented magnetic steel sheets having a finished strip thickness in the range of 0.1 mm to 0.5 mm from slabs produced by continuous casting or strip casting is as follows.

(1) The slabs contain (in percent by weight) more than
0.005%, preferably 0.02 to 0.10%, C
2.5 to 6.5% Si
0.03 to 0.15% Mn
0.0010 to 0.050% S
0.010 to 0.035% A
0.0045 to 0.0120% N
0.020 to 0.300% Cu,
and the balance Fe with residual impurities.

(2) The slabs are through-heated to a temperature which is lower than the solubility temperature $T_1$ of magnesium sulfide and higher than the solubility temperature $T_2$ of copper sulfide, wherein $T_1$ and $T_2$ depend on the Si content of the slab.

(3) The through-heated slab is first hot roughed to an intermediate thickness and subsequently or immediately thereafter hot finish rolled with a charge temperature of at least 960° C. and final rolling temperature of 880° C. to 1,000° C. to produce a hot rolled strip having a final thickness of 1.5 to 7 mm, during which at least 60% of the total nitrogen content in the slab is precipitated as coarse AlN particles.

(4) The hot rolled strip is then annealed for 100 to 600 seconds at a temperature of 800 ° C. to 1,150° C., followed by cooling at a cooling rate higher than 15° K./sec during which the maximum possible quantity of the total nitrogen content is precipitated in the form of coarse and fine AlN particles and copper is precipitated as fine copper sulfide particles.

Figure 1:
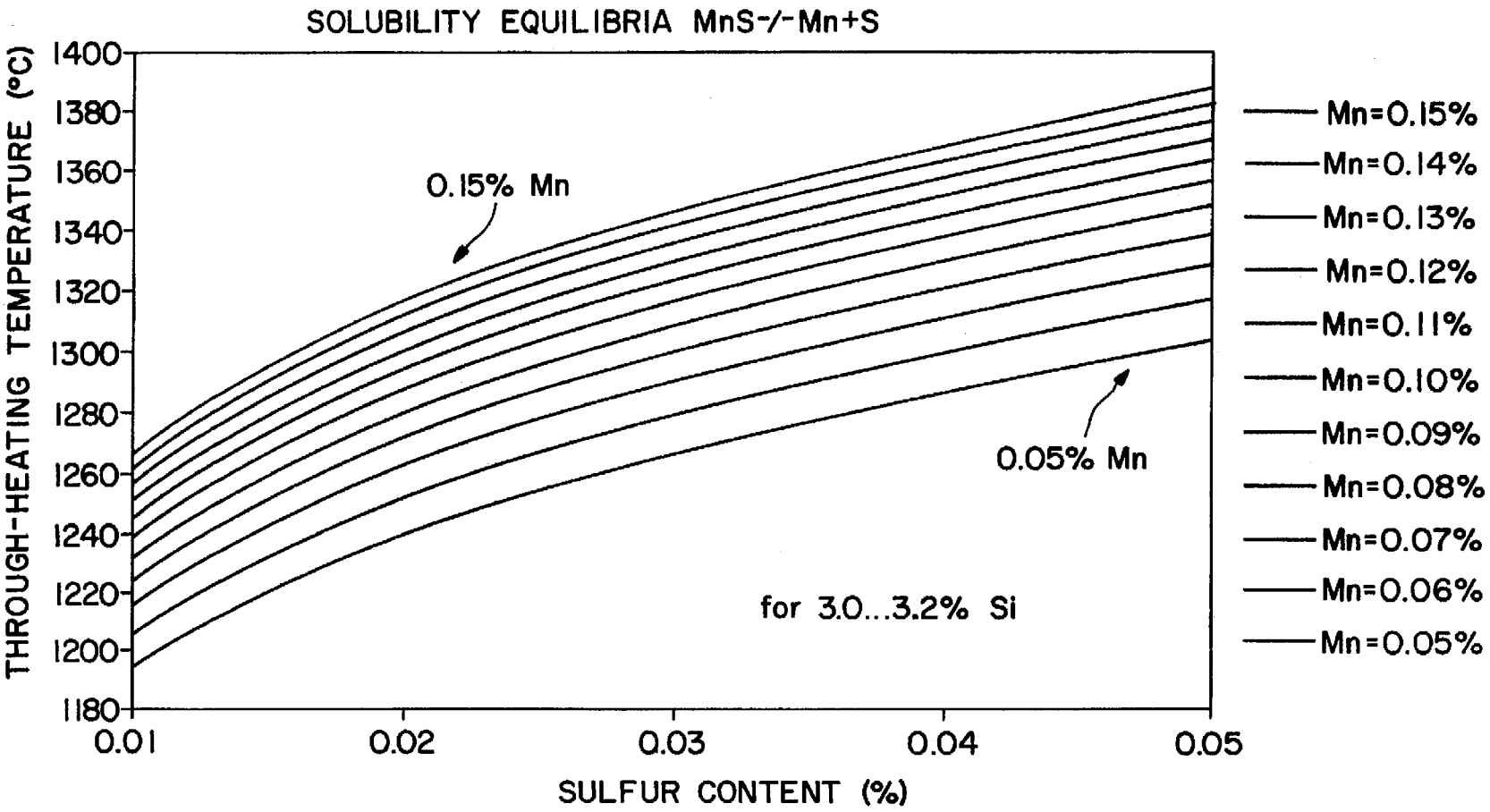
FIG. 1 illustrates the solubility temperature of manganese sulfide for a specific concentration of silicon.

Essential to the invention is feature (1), namely that the slabs also contain in addition to the usual nitrogen content in the range of 0.0045 to 0.0120% an additional 0.020 to 0.300% Cu and more than 0.010% S, but less than 0.035% Al. In addition, the effect of process steps (2) and (3) according to the invention is that manganese sulphides are practically not put in solution and are therefore present precipitated mainly in the form of coarse particles already after hot rolling. More particularly, in contrast with the conventional production of so-called RGO magnetic steel sheets (RGO=regular grain oriented), this means that with the use of the process according to the invention, manganese sulphides as an inhibitor are not operative in the subsequent stages or process steps. Furthermore, the through-heating of the slabs according to the invention as set forth in (2) has the effect that aluminium nitrides are put in solution in only a small proportion and are therefore present separated, also mainly in the form of coarse particles, after hot rolling has been performed in accordance with (3). This proportion also can no longer act as an inhibitor in the subsequent process steps.

In contrast with the conventional production of so-called HGO magnetic steel sheets (HGO=high-permeability grain oriented), the use of the process steps (1) to (4) according to the invention shows that a decisive grain growth inhibitor is very finely distributed precipitated copper sulphide particles having an average diameter of less than approximately 100 nm, preferably less than 50 nm, which in the following stages of process steps represent the actual, essential and operative control phase. Finely distributed aluminium nitrides also precipitated by the process step (4) according to the invention are operative as inhibitor only to a very small extent. This is shown more particularly by comparison examples not according to the invention, in which the process according to the invention is applied, with otherwise identical features and process steps, to slabs which have only a sulphur content of less than 0.005%. In these cases not enough particles acting as inhibitor are present.

In contrast with the process according to the invention, it is characteristic of the previous conventional production of RGO magnetic steel sheets (e.g., according to DE-A1 41 16 240) that in this case the slabs contain only a maximum of 0.005% Al, prior to hot rolling the slabs are through-heated at a temperature of the order of magnitude of approximately 1400° C., finely distributed MnS particles are adjusted as a substantially operative inhibitor by the hot rolling and the if necessary subsequent heat treatment of the rolling strips in the temperature range of approximately 900° C. to 1100° C., the magnetic steel sheets having as a rule only a magnetic induction $B_8$ of less than approximately 1.88 T.

The characteristics of the hitherto conventional process for the production of HGO magnetic steel sheets (e.g., according to DE-C2 29 09 500) is that the slabs contain approximately 0.010 to 0.065% Al and are through-heated prior to hot rolling also at a temperature of the order of magnitude of approximately 1400° C., finely distributed AlN particles are an essential inhibitor due to the hot rolling and the subsequent hot strip annealing, while such magnetic steel sheets preferably have a magnetic induction $B_8$ greater than 1.88 T.

As will be shown by the following embodiments and when the process according to the invention is explained in detail, grain oriented magnetic steel sheets can now be produced by the process according to the invention with the same magnetic induction $B_8$ in Tesla (T) as that possessed by RGO and also HGO magnetic electric sheets, but with improved values for the remagnetization loss $P_{1.7/50}$ in watts per kg (W/kg).

DETAILED DESCRIPTION OF THE INVENTION

In the process according to the invention, first of all the known continuous casting process is used to produce slabs having an initial thickness in the range of 150 to 300 mm, preferably in the range of 200 to 250 mm. Alternatively, the slabs can also be so-called thin slabs having an initial thickness in the range of approximately 30 to 70 mm. Advantageously, in these cases there is no need for roughing to an intermediate thickness in the production of hot strip according to process step (33). Furthermore, grain oriented magnetic steel sheets can also be produced by the process according to the invention from slabs or strips having an even smaller initial thickness, if said slabs or strips were previously produced by means of strip casting.

The slabs, thin slabs or strips, hereinafter referred to as slabs for short and so defined, have the carbon, silicon, manganese, nitrogen and copper contents stated above and also, in comparison with the prior art (disclosed in EP-B1 0 219 611), the increased sulphur content according to the invention in the range of more than 0.010, preferably more than 0.015%, up to 0.050%, and the aluminium content, deliberately reduced to the lower known range, in the range of 0.010 to 0.030%, up to 0.035% at the maximum, residue Fe including impurities. Preferably, the aluminium and sulphur contents are adjusted. The content of the remaining alloying compounds preferably lies within the ranges 3.0 to 3.3% Si, 0.040 to 0.070% C, 0.050 to 0.150% Mn, 0.020 to 0.035% S, 0.015 to 0.025% Al, 0.0070 to 0.0090% N, and 0.020 to 0.200% Cu for each alloying element on its own or in combination.

Advantageously, after process step (3) according to the invention has been performed, only a small number of cracks are observed at the hot strip edges, so that satisfactory hot strip edges and correspondingly high production are achieved; after process step (4) has been performed, a finer distribution is found in the copper sulphide particles acting as an essential inhibitor and as a whole, on completion of the process set forth in the preamble, grain oriented magnetic steel sheets having high values of magnetic induction $B_8$ are produced if the manganese, copper and sulphur contents of the slabs are so adjusted as to meet the harmonization rule (Mn×Cw/S=0.1 to 0.4, while more particularly the manganese and sulphur contents additionally lie in the two ranges 0.070 to 0.100% Mn and 0.020 to 0.025% S.

Up to 0.15%, but preferably only 0.02–0.06% tin can also be added to the composition. The magnetic properties are not further improved thereby.

Following the production of the slabs having the alloy composition set forth above, the slabs are heated to a temperature and through-heated at that temperature, which lies in the temperature range stated with process step (2) according to the invention. This temperature, which depends on the given manganese, sulphur and silicon contents, must in any case be lower than the associated solution temperature $T_1$ for manganese sulphides and at the same time clearly higher than the associated solution temperature $T_2$ for copper sulphides. This temperature range can be gathered from FIG. 3, which shows jointly the solubility curves according to FIGS. 1 and 2.

Figure 2:
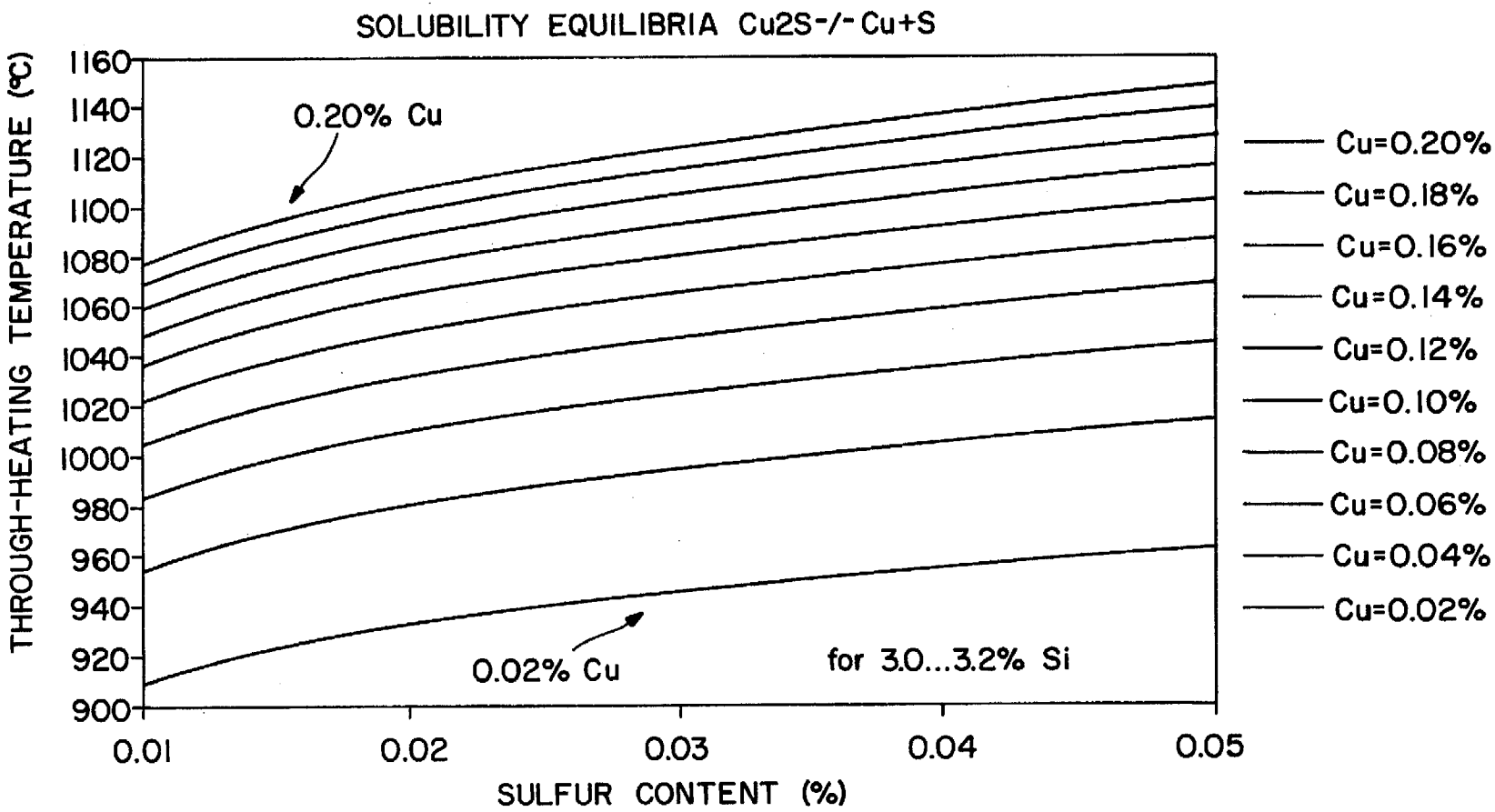
FIG. 2 illustrates the solubility temperature of copper sulfide for a specific concentration of silicon.
Figure 3:
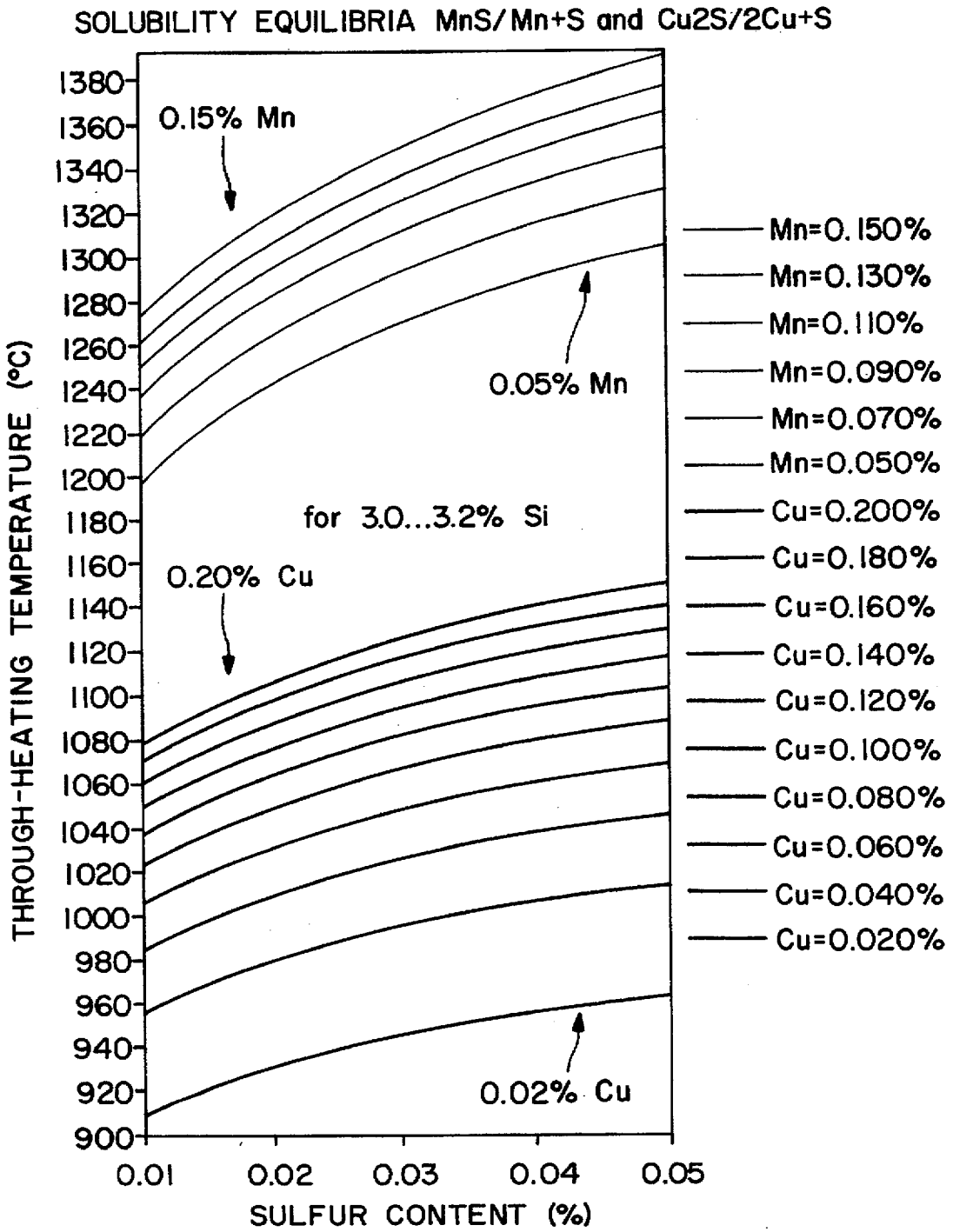
FIG. 3 being a combination of FIGS. 1 and 2.

FIG. 1 shows the solubility curve $T_1$=f (Mn, S, 3.0%–3.2% Si) for manganese sulphide, while FIG. 2 shows the solubility curve $T_2$=f (Cu, S, 3.0%–3.2% Si) for copper sulphide. FIGS. 1, 2 and 3 make clear the solution behaviour of grain oriented magnetic steel sheets with the usual Si contents. The contents considered correspond to the embodiments shown in Tables 1, 2 and 3.

The result of the performance of process step (2) is that in the through-heating of the slabs prior to hot rolling, manganese sulphides are practically not put into solution. Since the corresponding solubility curves for aluminium nitrides are similar to or comparable with the solubility curves for manganese sulphides, the main proportion of aluminium nitrides is also precipitated in the through-heating of the slabs according to the invention. On completion of this process step, practically exclusively copper sulphides are almost completely in solution.

After the slabs have been solution annealed, in accordance with process step (3) according to the invention they are if necessary first roughed in 3 to 7 passes and more particularly in 5 to 9 passes, in dependence on the initial thickness of the slabs, and then finish rolled to the hot strip final thickness in the range of 1.5 to 5 mm, up to a maximum of 7 mm. Slabs having an initial thickness in the range of 150 to 300 mm, preferably in the range of 200 to 250 mm, are roughed to a preliminary strip thickness in the range of approximately 30 to 60. mm. However, if the slabs are thin slabs or strips produced by strip casting, roughing can advantageously be dispensed with. As a whole, the number of passes during roughing and finish rolling is determined in accordance with the initial thickness of the slabs and required hot strip final thickness.

However, it is an essential feature of process step (3) that the strips are finish rolled with as low a final rolling temperature as possible, in the range of 880° C. to 1000° C., preferably in the range of 900° C. to 980° C. The lower limit is determined by the fact that problem-free shaping and strip rolling must still be possible without the occurrence of difficulties such as, for example, strip unevennesses and deviations from section. In connection with process step (2), on completion of process step (3) it is found that coarse MnS particles and a very large number of coarse AlN particles with an average diameter of more than 100 nm are present precipitated in the hot strip. On completion of the hot rolling according to the invention, more than 60% of the total nitrogen content is present bonded to aluminium in the form of AlN. A yardstick for the quantity of nitrogen present bonded to aluminium is the N Beeghly value. It is determined by a chemical process, as described in "Analytical Chemistry, Volume 21, No. 12, December 1949". In contrast, in the processes for the production of HGO magnetic steel sheets, only very few MnS particles and practically no AlN particles of this particle size (i.e., smaller than 100 nm) are present after the solution annealing of the slabs and on completion of hot rolling.

Then the heat treatment of the hot rolled strips is performed by process step (4) according to the invention in the temperature range of 880° C. to 1150° C., preferably in only one stage in the temperature range of 950° C. to 1100° C. However., it can also be performed in more than one stage. This heat treatment results in the precipitation of the particles having an average diameter smaller than 100 nm, preferably smaller than 50 nm, acting as. inhibitor in the following process steps. Thus, in the process according to the invention, after the hot strip annealing a large number of fine copper sulphide particles of this particle size are found, and in comparison therewith only a very small number of fine AlN particles. In contrast, in the process for the production of HGO magnetic steel sheets practically exclusively fine AlN particles of this size are present.

Table 4 shows clearly how the process according to the invention influences the nature and size of the precipitations and therefore their effectiveness as inhibitor. It also shows the differences in comparison with the separations which take place in the prior art processes (HGO, RGO).

As the comparison example 14 and 15 (Table 3) show, essential features of the process according to the invention are that the slabs must necessarily have a sulphur content higher than 0.010%, preferably higher than 0.015%, and in any case, hot strip annealing as set forth in process step (4) must be performed for the precipitation of the fine copper sulphide particles. If the hot strip annealing (4) is not performed, in the following process steps not enough particles acting as inhibitor are present which are smaller than 100 nm, preferably smaller than 50 nm, this being due to the premature precipitation of coarse MnS and AlN particles because of process steps (2) and (3).

On completion of hot strip annealing (4), the strips are cold rolled, preferably in one stage, to the finished strip thickness in the range of 0.1 to 0.5 mm. In dependence on the hot strip final thickness, cold rolling can also be performed in two stages (claim 6), while according to claim 7 a preliminary annealing is preferably performed prior to the first cold rolling stage. This advantageously contributes towards the stabilization of the secondary recrystallization in the subsequent high temperature annealing.

When cold rolling to the required final thickness has been performed, the strips are subjected in known manner to a recrystallization and decarburizing annealing at a temperature in the range of 750° C. to 900° C., preferably at a temperature in the range of 820° C. to 880° C. in an atmosphere containing moist $H_2$ and $N_2$. Then an annealing separator primarily containing MgO is applied. The strips are then annealed in known manner in a long-time hood-tight annealing furnace, with a slow heating of 10 to 100 K/h, preferably 15 to 25 K/h, to at least 1150° C., the strips being annealed at that temperature in an atmosphere consisting of $H_2$ and $N_2$ and, after being held for 0.5 to 30 h are slowly cooled again. Lastly, the also known insulating coatings with the associated final annealing are performed.

Using eight embodiments, Table 1 shows the results when the process according to the invention as set forth in claim 1 is applied to slabs having an initial thickness of 215 mm. Table 2 contains further results which were obtained by the process according to the invention. In these cases cold rolling was performed in two stages without and also with the preliminary annealing prior to the first cold rolling stage.

Figure 4:
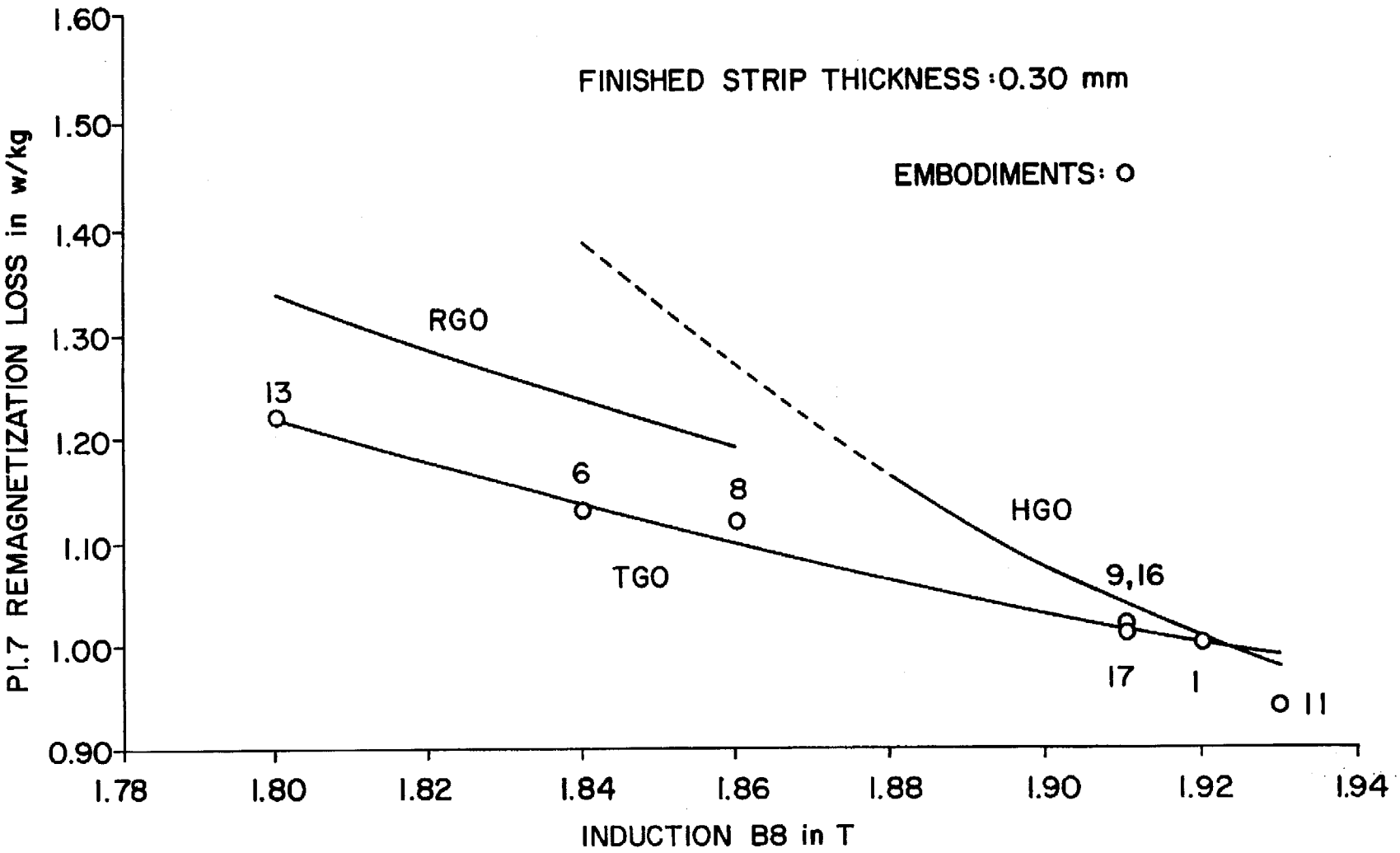
FIG. 4 illustrates the values of magnetic induction and remagnetization loss for grain oriented magnetic steel sheets produced in accordance with the process of the present invention.

As can be gathered from Tables 1 and 2, grain oriented magnetic steel sheets can be produced which have a magnetic induction $B_8$ such as is also possessed by grain oriented magnetic steel sheets of RGO and HGO quality. Using the process according to the invention, these qualities can, however, now be achieved solely by the use of a single process with the process steps set forth in claim 1. Furthermore, in addition to the advantages of the reduced temperature for the solution annealing of the slabs in the corresponding furnaces, substantially more favourable values are advantageously obtained for the associated remagnetization losses. This is made clear by FIG. 4, which shows for grain oriented magnetic steel sheets having a finished strip thickness of 0.30 mm, the values of magnetic induction and remagnetization loss, stated in Tables 1 and 2, in the form of a TGO (Thyssen grain oriented) graph curve. Furthermore, in comparison therewith, FIG. 4 shows the corresponding, typical pairs of values for grain oriented magnetic steel sheets of qualities RGO and HGO, which for the two have been obtainable solely in known manner by means of two different, separate processes.

TABLE 1

Grain oriented magnetic steel sheets, produced by the process according to the invention as set forth in claim 1 from slabs 215 mm thick, with a finished strip thickness in the range of 0.23 mm to 0.35 mm and with the achieved remagnetization loss $P_{1.7}/_{50}$ and the achieved magnetic induction $B_8$.

| | Serial Number | | | | | | | |
|---|---|---|---|---|---|---|---|---|
| | 1 | 2 | 3 | 4 | 5 | 6 | 7 | 8 |
| Chemical Composition | | | | | | | | |
| Si/% | 3.18 | 3.11 | 3.12 | 3.14 | 3.14 | 3.13 | 3.12 | 3.18 |
| C/% | 0.057 | 0.056 | 0.057 | 0.056 | 0.055 | 0.057 | 0.057 | 0.057 |
| Mn/% | 0.070 | 0.074 | 0.074 | 0.069 | 0.069 | 0.069 | 0.074 | 0.070 |
| S/% | 0.026 | 0.023 | 0.023 | 0.022 | 0.022 | 0.023 | 0.023 | 0.026 |
| Al/% | 0.026 | 0.025 | 0.025 | 0.022 | 0.022 | 0.021 | 0.025 | 0.026 |
| N/% | 0.0078 | 0.0081 | 0.0082 | 0.0080 | 0.0080 | 0.0081 | 0.0082 | 0.0078 |

TABLE 1-continued

Grain oriented magnetic steel sheets, produced by the process according to the invention as set forth in claim 1 from slabs 215 mm thick, with a finished strip thickness in the range of 0.23 mm to 0.35 mm and with the achieved remagnetization loss $P_{1.7/50}$ and the achieved magnetic induction $B_8$.

| | Serial Number | | | | | | | |
|---|---|---|---|---|---|---|---|---|
| | 1 | 2 | 3 | 4 | 5 | 6 | 7 | 8 |
| Cu/% | 0.066 | 0.072 | 0.073 | 0.066 | 0.066 | 0.066 | 0.073 | 0.066 |
| Hot Strip Production | | | | | | | | |
| Slabs-through-heating/min | 224 | 264 | 456 | 482 | 480 | 242 | 456 | 224 |
| Furnace/through-heating temperature/°C. | 1270 | 1260 | 1260 | 1270 | 1270 | 1260 | 1260 | 1270 |
| Preliminary Strip thickness/mm | 30 | 50 | 50 | 50 | 50 | 50 | 50 | 30 |
| Charge temperature finish rolling/°C. | 990 | 1015 | 1015 | 1015 | 1015 | 1005 | 1015 | 990 |
| Hot-Strip - final thickness/mm | 2.3 | 2.3 | 2.3 | 2.3 | 2.3 | 2.3 | 2.3 | 2.3 |
| Final rolling temperature/°C. | 920 | 950 | 960 | 940 | 960 | 965 | 960 | 920 |
| Coiling temperature/°C. | 650 | 620 | 630 | 650 | 640 | 635 | 630 | 650 |
| N Beeghly value/% | 0.0054 | 0.0049 | 0.0065 | 0.0051 | 0.0050 | 0.0054 | 0.0065 | 0.0054 |
| Cold Strip Production | | | | | | | | |
| Duration of hot strip annealing/s | 240 | 240 | 240 | 240 | 240 | 240 | 240 | 240 |
| Hot strip annealing temperature/°C. | 1060 | 1080 | 1080 | 0180 | 1050 | 1080 | 1020 | 1000 |
| Cooling rate/K/s | 16 | 24 | 30 | 26 | 25 | 30 | 28 | 30 |
| N Beeghly value/% | 0.0077 | 0.0076 | 0.0078 | 0.0075 | 0.0075 | 0.0072 | 0.0075 | 0.0072 |
| Cold rolling-final thickness (one stage)/mm | 0.30 | 0.27 | 0.23 | 0.35 | 0.27 | 0.30 | 0.27 | 0.30 |
| Decarburization, high annealing, final insulation | | | | | | | | |
| Magnetic Properties | | | | | | | | |
| $P_{1.7}$ /W/kg | 1.00 | 0.97 | 1.05 | 0.97 | 1.14 | 1.13 | 1.07 | 1.12 |
| $B_8$/T | 1.92 | 1.93 | 1.88 | 1.93 | 1.86 | 1.84 | 1.87 | 1.86 |

TABLE 2

Grain oriented magnetic steel sheets, produced by the process according to the invention as set forth in claims 6 and 7 from slabs 215 mm thick, with a finished strip thickness in the range of 0.23 mm to 0.30 mm and with the achieved remagnetization loss $P_{1.7/50}$ and the achieved magnetic induction $B_8$.

| | Serial Number | | | | |
|---|---|---|---|---|---|
| | 9 | 10 | 11 | 12 | 13 |
| Chemical Composition | | | | | |
| Si/% | 3.11 | 3.11 | 3.11 | 3.18 | 3.12 |
| C/% | 0.063 | 0.055 | 0.063 | 0.057 | 0.057 |
| Mn/% | 0.095 | 0.074 | 0.095 | 0.070 | 0.074 |
| S/% | 0.024 | 0.023 | 0.024 | 0.026 | 0.023 |
| Al/% | 0.023 | 0.025 | 0.023 | 0.026 | 0.025 |
| N/% | 0.0088 | 0.0084 | 0.0088 | 0.0078 | 0.0082 |
| Cu/% | 0.070 | 0.072 | 0.070 | 0.066 | 0.073 |
| Hot Strip Production | | | | | |
| Slabs-Through-heating/min | 476 | 223 | 476 | 224 | 456 |
| Furnace/Through-heating temperature/°C. | 1280 | 1270 | 1280 | 1270 | 1260 |
| Preliminary Strip Thickness/mm | 50 | 50 | 50 | 30 | 50 |
| Charge temperature finish rolling/°C. | 1020 | 1030 | 1020 | 990 | 1015 |
| Hot strip - final thickness/mm | 2.3 | 2.3 | 2.3 | 2.3 | 2.3 |
| Final rolling temperature/°C. | 930 | 930 | 930 | 920 | 960 |
| Coiling temperature/°C. | 635 | 620 | 635 | 650 | 630 |
| N Beeghly value/% | 0.0053 | 0.0056 | 0.0053 | 0.0054 | 0.0065 |
| Cold Strip Production | | | | | |
| Duration of preliminary annealing/s | entfäit | 180 | 180 | 180 | 180 |
| Preliminary annealing temperature/°C. | entfäit | 990 | 980 | 990 | 990 |
| Cooling rate/K/s | entfäit | 10 | 8 | 11 | 10 |
| Cold rolling-intermediate thickness (first stage)/mm | 1.55 | 1.80 | 1.55 | 1.55 | 1.55 |
| Duration of hot strip annealing*(/s | 240 | 240 | 240 | 240 | 240 |
| Hot strip annealing temperature*)/°C. | 1080 | 1080 | 1080 | 1080 | 1080 |
| cooling rate/K/s | 28 | 29 | 24 | 26 | 28 |
| Cold rolling - final thickness (2nd stage)/mm | 0.30 | 0.27 | 0.30 | 0.23 | 0.30 |

TABLE 2-continued

Grain oriented magnetic steel sheets, produced by the process according to the invention as set forth in claims 6 and 7 from slabs 215 mm thick, with a finished strip thickness in the range of 0.23 mm to 0.30 mm and with the achieved remagnetization loss $P_{1.7/50}$ and the achieved magnetic induction $B_8$.

| | Serial Number | | | | |
|---|---|---|---|---|---|
| | 9 | 10 | 11 | 12 | 13 |
| Decarburization, high annealing, final insulation | | | | | |
| Magnetic Properties | | | | | |
| $P_{1.7}$ /W/kg | 1.02 | 0.99 | 0.94 | 0.92 | 1.22 |
| $B_8$/T | 1.92 | 1.92 | 1.93 | 1.91 | 1.80 |

*According to process step (4)

TABLE 3

Comparison examples 14 and 15 not according to the invention, and grain oriented magnetic steel sheets produced by the process according to the invention from Sn-containing slabs 215 mm thick, having a finished strip thickness of 0.30 mm (16 and 17) and with the achieved remagnetixation loss $P_{1.7/50}$ and the achieved magnetic induction $B_8$.

| | Serial Number | | | |
|---|---|---|---|---|
| | 14 | 15 | 16 | 17 |
| Chemical Composition | | | | |
| Si/% | 3.12 | 3.09 | 3.08 | 3.11 |
| C/% | 0.057 | 0.050 | 0.061 | 0.063 |
| Mn/% | 0.074 | 0.148 | 0.080 | 0.095 |
| S/% | 0.023 | 0.003 | 0.023 | 0.024 |
| Al/% | 0.025 | 0.029 | 0.020 | 0.023 |
| N/% | 0.0082 | 0.0072 | 0.0079 | 0.0088 |
| Cu/% | 0.073 | 0.073 | 0.068 | 0.070 |
| Sn/% | | | 0.026 | 0.118 |
| Hot Strip Production | | | | |
| Slabs-through-heating/min | 456 | 421 | 423 | 476 |
| Furnace/through-heating temperature/°C. | 1260 | 1270 | 1260 | 1280 |
| Preliminary strip thickness/mm | 50 | 50 | 50 | 50 |
| Charge temperature finish rolling/°C. | 1015 | 1010 | 1020 | 1020 |
| Hot strip - final thickness/mm | 2.3 | 2.3 | 2.3 | 2.3 |
| Final rolling temperature/°C | 960 | 960 | 955 | 930 |
| Coiling temperature/°C. | 630 | 630 | 620 | 635 |
| N Beeghly value/% | 0.0065 | 0.0061 | 0.0053 | 0.0065 |
| Cold Strip Production | | | | |
| Duration of hot strip annealing/s | entfäit | 240 | 240 | 240 |
| Hot strip annealing temperature/°C. | entfäit | 1080 | 1120 | 1080 |
| Cooling rate/K/s | entfäit | 27 | 30 | 28 |
| N Beeghly value/% | entfäit | 0.0070 | 0.0075 | 0.0082 |
| Cold rolling - final temperature (one stage)/mm | 0.30 | 0.30 | 0.30 | 0.30 |
| Decarburization, high annealing, final insulation | | | | |
| Magnetic Properties | | | | |
| $P_{1.7}$ /W/kg | 2.18 | 1.84 | 1.02 | 1.01 |
| $B_8$/T | 1.49 | 1.64 | 1.91 | 1.91 |

TABLE 4

Number of Precipitations of the Particular Type, Referred to the Total Quantity:

| Type of Particle | Particle Size | Hot Rolled Strip | | After Heat Treatment/ Annealing (process according to examples) | |
|---|---|---|---|---|---|
| Copper Sulfides | Inhibitors | 5% | 55% | 70% | — |
| | Coarse Particles | — | — | — | 10% |
| MnS | Inhibitors | — | 5% | — | 20% |
| | Coarse Particles | 55% | 35% | 10% | 5% |
| AlN | Inhibitors | — | 5% | 10% | 65% |
| | Coarse Particles | 40% | — | 10% | — |
| State of the Art, referred to HGO | | According to the Invention | Prior Art | According to the Invention | Prior Art |
| Copper Sulfides | Inhibitors | 5% | 30% | 70% | 30% |
| | Coarse Particles | — | 10% | — | 10% |
| MnS | Inhibitors | — | 50% | — | 50% |
| | Coarse Particles | 55% | 10% | 10% | 10% |
| AlN | Inhibitors | — | — | 10% | — |
| | Coarse Particles | 40% | — | 10% | — |
| State of the Art, Referred to RGO | | According to the Invention | Prior Art | According to the Invention | Prior Art |

We claim:

1. A process for the production of grain-oriented magnetic steel sheets, comprising:

(1) through-heating a slab consisting of, in % by weight,
0.005 to 0.10% C
2.5 to 6.5% Si
0.03 to 0.15% Mn
0.010 to 0.050% S
0.010 to 0.035% Al
0.0045 to 0.0120% N
0.020 to 0.300% Cu
balance Fe and inevitable impurities
to a temperature which is lower than the solubility temperature $T_1$ of manganese sulfide and higher than the solubility temperature $T_2$ of copper sulfide;

(2) hot roughing and then hot finish rolling said through-heated slab at an initial temperature of at least 960° C. and a final temperature of 880° C. to 100° C. to produce a hot rolled strip having a thickness of 1.5 to 7 mm, during which at least 60% of the total nitrogen content in said slab is precipitated as coarse AlN particles and cooling said hot rolled strip at a temperature of less than 700° C.;

(3) annealing said hot rolled strip for 100 to 600 seconds at a temperature of 880° C. to 1150 ° C., followed by cooling at a cooling rate which is greater than 15 K/sec, during which additional nitrogen and copper is precipitated as coarse and fine AlN particles and fine copper sulfide particles to form a cooled strip;

(4) cold rolling said cooled strip in at least one cold rolling step to produce a cold rolled strip having a finished strip thickness of 0.1 mm to 0.5 mm;

(5) subjecting said cold rolled strip to recrystallization and decarburization annealing in a wet atmosphere containing $H_2$ and $N_2$;

(6) coating with a separating agent containing MgO as a main ingredient on both sides of said recrystallized and decarburized strip;

(7) heating said coated strip at a heating rate of 10 to 100 K./hr to an annealing temperature of at least 1150° C.; and (8) after allowing said annealed strip to cool, applying an insulating coating to said annealed and cooled strip and subjecting said insulating coated strip to a final annealing.

2. The process of claim 1 wherein said slab consists of, in percent by weight,
3.0 to 3.3% Si
0.040 to 0.070% C
0.050 to 0.150% Mn
0.020 to 0.035% S
0.015 to 0.024% Al
0.0070 to 0.0090% N
0.020 to 0.200% Cu and
balance Fe and inevitable impurities.

3. The process according to claim 1, wherein the Mn, Cu, and S contents correspond to the following formula:

$$(Mn \times Cu)/S = 0.1 \text{ to } 0.4.$$

4. The process according to claim 1, wherein the manganese and sulfur contents of the slab consist of, in percent by weight 0.070 to 0.100% Mn and 0.020 to 0.025% S.

5. The process according to claim 1, wherein said hot rolled strip is annealed at a temperature of 950° C. to 1,100° C.

6. The process according to claim 1, wherein prior to said annealing and cooling step (3), said hot rolled strip is first roughed in a first cold rolling stage to an intermediate thickness, and following said annealing and cooling step (3), said cooled strip is cold rolled in a second cold rolling step with a degree of reduction of at least 65% to said finished strip thickness.

7. The process of claim 6, wherein said cooled strip is cold rolled in said second cold rolling step with a degree of reduction of at least 75%.

8. The process of claim 6, further comprising annealing said hot rolled strip at a temperature of 800° C. to 1,000° C. prior to said first cold rolling step.

9. The process of claim 1, further comprising holding said cooled strip at a temperature of 100° to 300° C. during at least one pass of said cold rolling step.

10. The process of claim 6 further comprising holding said cooled strip at a temperature of 100° C. to 300° C. during at least one pass of said second cold rolling step.

11. The process of claim 1 wherein the final rolling temperature is in the range of 900° C. to 980° C.

* * * * *